United States Patent [19]

Buchner

[11] 4,141,154

[45] Feb. 27, 1979

[54] METHOD FOR THE COOLING OF A SHAFT FURNACE FOR THE CALCINING OF LIME, DOLOMITE OR MAGNESITE

[75] Inventor: Heinrich Buchner, Bochum, Fed. Rep. of Germany

[73] Assignee: Klöckner-Humboldt-Deutz, Fed. Rep. of Germany

[21] Appl. No.: 859,148

[22] Filed: Dec. 9, 1977

[30] Foreign Application Priority Data

Dec. 17, 1976 [DE] Fed. Rep. of Germany ..... 2657238

[51] Int. Cl.[2] ..... F26B 7/00; F27B 3/24

[52] U.S. Cl. ..... 34/20; 432/26; 432/77; 432/106

[58] Field of Search ..... 34/20; 432/26, 77, 83, 432/102

[56] References Cited

U.S. PATENT DOCUMENTS

| | | | |
|---|---|---|---|
| 2,377,943 | 6/1945 | Kennedy | 34/20 X |
| 3,546,893 | 12/1970 | Frudeger | 34/20 |
| 3,922,797 | 12/1975 | Dick | 34/20 |

FOREIGN PATENT DOCUMENTS

| | | | |
|---|---|---|---|
| 1156694 | 10/1963 | Fed. Rep. of Germany | 432/102 |

*Primary Examiner*—John J. Camby

*Attorney, Agent, or Firm*—Hill, Gross, Simpson, Van Santen, Steadman, Chiara & Simpson

[57] ABSTRACT

A method and apparatus is disclosed for the cooling of a lime shaft furnace for the calcining of limestone and which is operable with a combustible fuel. In shaft chambers of the shaft furnace, a hollow beam is provided to convey combustible fuel into the shaft chamber. Associated with the hollow beam is a cooling unit for cooling walls of the beam. A closed circuit cooling liquid system connects with the cooling unit so as to maintain a flow of a cooling liquid through the cooling unit. The cooling liquid has a boiling point of greater than 100° C. This cooling liquid is continuously recooled by a heat exchanger.

19 Claims, 1 Drawing Figure

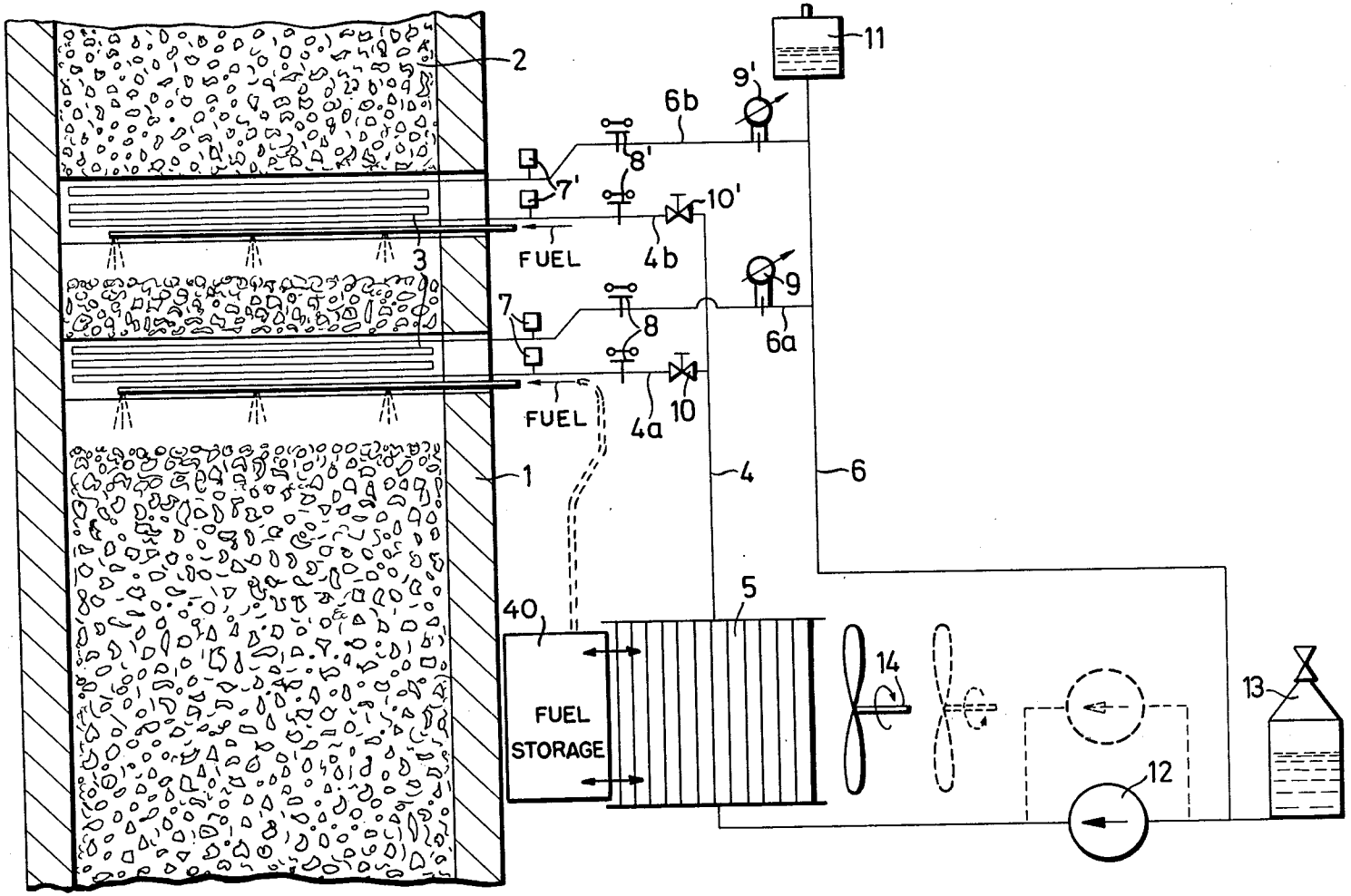
FUEL
FUEL
FUEL
STORAGE

METHOD FOR THE COOLING OF A SHAFT FURNACE FOR THE CALCINING OF LIME, DOLOMITE OR MAGNESITE

BACKGROUND OF THE INVENTION

1. Field of the Invention

The invention relates to a method for the cooling of a shaft furnace fed with liquid or gaseous fuels, for the calcining of limestone, for example, and wherein the fuel passes via hollow beams. Cooling chambers are also provided for passing through a cooling liquid into the shaft furnace chamber.

2. Description of the Prior Art

During the calcining of limestone in shaft furnaces, it is known to install hollow beams in order to be able to distribute the liquid or gaseous fuels as uniformly as possible over the entire cross-section of the combustion zone. During operation, these hollow beams are heated quite highly in known manner so that cooling is advantageous.

From German Pat. No. 1,156,694 it is further known to cool by use of water hollow beams which bring liquid or gaseous fuels into the combustion zone of lime-shaft furnaces. This takes place such that in the side walls of the hollow beams, cooling chambers are constructed which have water flowing therethrough. In this way, the walls of the hollow beams are protected from excessive heating. By this cooling method, the utilizable temperature difference of the cooling liquid, however, is slight, while the temperature difference between the cooling liquid and the interior of the furnace is great. The use of cooling water is appreciable. Besides, high temperature gradients and large material stresses occur in the hollow carriers.

SUMMARY OF THE INVENTION

It is an object of the invention to indicate a cooling method for lime-shaft furnaces which does not have the aforementioned disadvantages, and which makes possible excellent cooling regulation. The solution of the problem is attained in that as a cooling liquid a temperature-resistant organic or inorganic liquid is used with a boiling point of more than 100° C., and which circulates in a closed circuit.

Through the utilization of a temperature-resistant liquid with a boiling point of more than 100° C., advantageously a higher temperature is possible in the interior of the cooling system so that the utilizable temperature difference of the cooling liquid increases and the heat removal per unit volume is improved. Through the utilization of a closed circuit, the advantage results that the quantity of cooling liquid remains restricted to the quantity used in filling the cooling circuit. Furthermore, with a medium free from foreign material, cloggings or deposits are out of the question.

In one embodiment of the invention, as cooling liquid a heat-carrying oil is used, particularly a silicon oil. With this oil it is advantageously possible to obtain a temperature range above 100° C. as an operating temperature range of the cooling liquid with a medium which is used commercially and which is easily manipulatable. Especially advantageous in this connection is the good heat transfer between the steel of the beam and the heat carrier oil which permits a reliable cooling even in difficult places.

In a special development of the method, it is provided that the operating temperature of the cooling liquid lies between 200° C. and 270° C., particularly between 200° C. and 220° C. This is an especially favorable range in which, on the one hand, the temperature of the cooling liquid is sufficiently high in order to attain the positive effects according to the invention, and on the other hand, there still exists a sufficient safety margin at the point at which the steam pressure in the heat carrier oil would become too high. The formation of steam bubbles is thus reliably prevented.

In a further embodiment of the invention, it is provided that the cooling liquid is re-cooled in a cooler or radiator by means of air. This results in an especially advantageous possibility of cooling shaft furnaces which are to be driven without constant utilization of water. The re-cooling by means of air is particularly advantageous with the use of a heat carrier oil with its high temperature level. Upon the re-cooling of water, only a small quantity of temperature difference between cooling air and water would be available, so that large coolers would be necessary. With the high differential temperature of the heat carrier oil, to the contrary, only a small cooler is necessary for the carrying off of the same quantity of heat.

In a further embodiment, it is provided that the cooling liquid is cooled off in the heat exchange process by means of the fuel of the shaft furnace. What is involved here is an especially advantageous solution which, particularly for the firing of the lime-shaft furnace, permits a preheating of heating oil fuel used for the furnace in combination with a good re-cooling of the cooling liquid. Thus, a complete return recovery of the quantity of heat conveyed off through the cooling is attained. Therefore, as a whole this embodiment permits the best utilization of the energy supplied to the calcining process.

Furthermore, it is provided that the cooling liquid circuit is supervised at each hollow beam through pressure control systems, thermostats, and flow measuring devices. Consequently there is available a direct acting, reliable system for the supervision of the cooling circuit which reacts immediately to a rise in temperature and/or a stoppage of flow. When disturbances occur, the system carries out an immediate shut-off of the corresponding carrier. In this way, the danger of discharge of the heat carrying oil, which previously had prevented prior users from providing cooling circuits with a combustible liquid, is decreased to such an extent that the introduction of combustible cooling liquids in lime-shaft furnaces is possible. Thus even with the utilization of a heat carrying oil, a reliable and certain cooling is attained which is not inferior with respect to the reliability in cooling with a non-combustible medium.

In a development of the method, an apparatus is provided for the cooling of a lime-shaft furnace which has a closed circuit cooling liquid conduit which is filled with a cooling liquid with a boiling temperature above 100° C. Therefore, there is available advantageously an apparatus for carrying out the advantages accomplished according to the inventive method.

In one development of the apparatus, it is provided that the cooling liquid conduit has a re-cooler, which is constructed as a pipe or honeycomb cooler, with air flowing through. Therefore there is advantageously available a simple system for return cooling which is easy to adjust. With the use of a heat carrying oil as a cooling liquid, not once is it necessary to provide protection against corrosion.

In a further embodiment it is provided that the cooling liquid conduit has a re-cooler which is constructed as a heat exchanger and which is connected with the fuel supply or the fuel storage. Therefore the use of the heat conveyed off through the cooling liquid from the furnace is possible for the preheating of the fuel so that, viewed as a whole, no thermal energy is lost through the cooling.

Furthermore, in a development of the invention it is provided that the cooling liquid conduit has at each hollow beam at least two pressure control systems, two thermostats and a flow measuring device. In this way, there are available devices which are absolutely necessary for the carrying out of the method and which make it possible, without danger and without chance of explosion, to utilize a combustible liquid in the cooling system of a shaft furnace.

BRIEF DESCRIPTION OF THE DRAWING

The drawing shows diagrammatically a lime-shaft furnace according to the invention with an associated cooling liquid circulation system.

Referring to the drawing, reference numeral 1 shows the lime-shaft furnace and 2 the charge located in the lime-shaft furnace. The hollow beams for supply of the fuel into the inner part of the shaft furnace is designated by 3. They are arranged in several planes and are offset with respect to one another within the planes such that the entire cross-sectional surface of the shaft furnace may be heated by the burners. Within the hollow beam 3, the cooling liquid is conveyed several times to and fro, so that supply and take off of the cooling liquid takes place from one side. In this regard, the supply of the cooling liquid to the hollow beams 3 takes place through the conduit 4 and the return conveyance to the cooler 5 through the conduit 6. From the supply conduit 4 extend branch conduits **4*a* and 4*b* to the individual hollow beams. The branch conduits 6*a* and 6*b* connect the hollow beam 3 with the return conveyance conduit 6. In the conduits 4*a* and 4*b* or 6*a* and 6*b*, respectively, are located the necessary measuring and regulating devices. In each delivery and take off conduit a pressure control system 7 or 7' and a rapid closure thermostat valve 8 or 8' are provided. Furthermore, the return conveyance connecting conduits 6*a* and 6*b* represent flow measuring devices 9 or 9' for the cooling liquid, which are constructed as diaphragm measuring devices with differential pressure manometers. For the rapid shut-off of the supply or delivery, pneumatic valves 10 or 10' are arranged in the supply connecting conduits 4*a* and 4*b***.

Above the highest point of the cooling circuit is arranged an equilization container 11 for the equalization of the changes in volume of the cooling liquid, and in front of the pump 12 is located the in-fill and refill container 13. The cooler 5 has a controllable blower 14. Blower 14 and pump 12 are in each case present in redundance.

The operation of the cooling method according to the invention is as follows. The cooling liquid introduced through the in-fill and refill container 13 into circulation is set in motion by means of the pump 12. After the pump 12 the liquid flows through the pipe or plate cooler 5 and is there cooled by means of the air current produced by the blower 14. The blower 14 is either an axial blower or a radial blower. The radial blower is arranged preferably sideways to the cooler.

After the cooler or radiator 5 the cooling liquid flows through the conduit 4 to the hollow beams 3 via the branch conduits **4*a* and 4*b*. The conduits 4*a* and 4*b*, as a result of the relatively small quantity of cooling liquid per hollow beam, preferably have only a small diameter of 40–50 mm. After multiple flow-through of the hollow beam 3 as a result of flow through multiple installed conducting members, the cooling liquid is heated from the normal cooler starting temperature of 20° C.–150° C. to 270° C. The cooling liquid then flows through the branch conduits 6*a* and 6*b* and the conduit 6 back to the pump 12**. From this point, a new circulation commences.

In order to insure that in all hollow carriers 3 a flow-through takes place, each outlet conduit **6*a* or 6*b* has a flow control system 9. On the entry side of the hollow beam 3 is arranged in the conduits 4*a*, 4*b* in each case a pneumatic rapid closure valve 10, which is connected with a compressed air storage, and which insures that a switching possibility is always present. For the supervision of the flow of cooling liquid through the hollow beam 3, in each case pressure control systems 7 and thermostats 8 are arranged in the inlet and outlet conduits (4*a*, *b* and 6*a*, *b***). Through the protection circuit it is insured that in case of disturbance, particularly upon melting or burning through of a hollow beam or some other damaging of the cooling circuit, an immediate disconnection or shutoff takes place, so that no outflow of cooling liquid occurs through the leakage point. By this technique, it is possible to operate with combustible cooling media and to abandon the non-combustible cooling media only considered suitable in the past.

The cooling method according to the invention is usable not only in the form of water free re-cooling by air, as shown in FIG. 1. Aside from the form shown, the cooling off may also be carried out through a heat exchange with the fuel. In this case, as shown in the drawing, a cooling hose or a similar apparatus may be installed in a storage container 40 or in the feed bin for the fuel. Hereby it is advantageously possible, even with the use of gas, to supply the heat conveyed off by the cooling liquid for use with the system. With the use of heating oil, there result still further advantages through the increase in the viscosity.

Although various minor modifications may be suggested by those versed in the art, it should be understood that I wish to embody within the scope of the patent warranted hereon, all such embodiments as reasonably and properly come within the scope of my contribution to the art.

I claim as my invention:

1. A method for the cooling of a lime shaft furnace for the calcining of limestone and which is operable with a combustible fuel, comprising the steps of: providing at least one shaft chamber in the shaft furnace; conveying the combustible fuel through a hollow beam means into the shaft chamber, said hollow beam means having a cooling means adjacent thereto in the shaft chamber; and conveying a temperature resistant cooling liquid in a closed circuit through the cooling means, said liquid having a boiling point of more than 100° C.

2. The method of claim 1 in which the cooling liquid is organic.

3. The method of claim 1 in which the cooling liquid is inorganic.

4. The method of claim 1 in which the fuel is a liquid.

5. The method of claim 1 in which the fuel is a gas.

6. The method for the cooling of a lime shaft furnace according to claim 1 in which the cooling liquid is a heat carrying oil.

7. The method of claim 6 in which the oil is a silicon oil.

8. The method for the cooling of a lime shaft furnace, according to claim 1 in which the operating temperature of the cooling liquid is regulated between 100° C. and 270° C.

9. The method of claim 8 in which the regulated operating temperature is between 200° C. and 220° C.

10. The method for the cooling of a lime shaft furnace according to claim 1 in which the cooling liquid is cooled and recooled in a cooler by use of air.

11. The method for the cooling of a lime shaft furnace according to claim 1 in which the cooling liquid is cooled and recooled through a heat exchange with the fuel of the shaft furnace.

12. The method for the cooling of a lime shaft furnace according to claim 1 in which the cooling liquid closed circuit is supervised by use of pressure control systems, thermostats, and flow measurement devices.

13. A cooling system for a lime shaft furnace for the calcining of limestone and which is operable with a combustible fuel, comprising: a lime shaft furnace having at least one shaft chamber therein; a hollow beam means for conveying the combustible fuel into the shaft furnace, said hollow carrier having a cooling means adjacent thereto in the shaft chamber; a closed circuit cooling liquid conduit system connected to the cooling means; and a cooling liquid in the conduit system which flows through the cooling means, said cooling liquid having a boiling temperature above 100° C.

14. The system of claim 13, characterized in that the cooling liquid conduit system has a re-cooler which is constructed as a heat exchange radiator flowed through by air.

15. The system of claim 13, characterized in that the cooling liquid conduit system has a re-cooler which is constructed as a heat exchanger with a fuel supply system.

16. The system of claim 13, characterized in that the cooling liquid conduit system has at least two pressure control systems, two thermostats, and a flow measuring device.

17. A cooling system for a lime shaft furnace for the calcining of limestone and which is operable with a combustible fuel, comprising: a lime shaft furnace having a shaft chamber therein; hollow beam means in the shaft chamber for conveying combustible fuel into the shaft furnace; cooling means in the shaft chamber for cooling the hollow beam means; a closed circuit cooling liquid conduit system connected to the cooling means; and a cooling liquid in the conduit system having a boiling temperature above 100° C., whereby the hollow carrier means is cooled with a cooling liquid operable at higher temperatures and in a closed system.

18. The system of claim 17 in which the cooling means comprises means directly connected to walls of the hollow beam means to cool said walls.

19. The system of claim 16 wherein monitoring means are provided to prevent excessive operating temperatures of the cooling liquid, said cooling liquid comprising a heat carrying oil.

* * * * *